US006622375B1

(12) United States Patent
Endo et al.

(10) Patent No.: US 6,622,375 B1
(45) Date of Patent: Sep. 23, 2003

(54) METHOD FOR PRODUCING A FUSE ELEMENT

(75) Inventors: Takayoshi Endo, Shizuoka (JP); Takashi Ishii, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/667,299

(22) Filed: Sep. 25, 2000

Related U.S. Application Data

(62) Division of application No. 09/212,278, filed on Dec. 16, 1998, now Pat. No. 6,163,244.

(30) Foreign Application Priority Data

Dec. 16, 1997 (JP) ..... 9-346542

(51) Int. Cl.[7] ..... H01H 69/02
(52) U.S. Cl. ..... 29/623; 337/198; 337/160
(58) Field of Search ..... 29/610.1, 619, 29/620, 621.1, 622, 623; 337/198, 152, 160, 216, 266, 270

(56) References Cited

U.S. PATENT DOCUMENTS

| | | | | | |
|---|---|---|---|---|---|
| 2,816,989 | A | | 12/1957 | Sugden | 200/135 |
| 4,315,235 | A | | 2/1982 | Jacobs, Jr. | 337/296 |
| 4,357,588 | A | | 11/1982 | Leach et al. | 337/160 |
| 4,831,353 | A | * | 5/1989 | Gaia et al. | 29/623 |
| 5,097,246 | A | | 3/1992 | Cook et al. | 337/297 |
| 5,140,295 | A | * | 8/1992 | Vermot-gaud et al. | 337/297 |
| 5,453,726 | A | | 9/1995 | Montgomery | 37/290 |
| 5,668,522 | A | | 9/1997 | Kondo et al. | 337/198 |
| 5,898,357 | A | | 4/1999 | Endo et al. | 337/159 |
| 6,163,244 | A | * | 12/2000 | Endo et al. | 337/160 |

FOREIGN PATENT DOCUMENTS

| | | | | |
|---|---|---|---|---|
| DE | 39 09 302 A1 | | 10/1989 | H01H/85/06 |
| GB | 349519 | | 5/1931 | |
| GB | 232573 | * | 6/1999 | |
| JP | 64-60937 | * | 3/1989 | |
| JP | 1-315925 | | 12/1989 | H01H/85/08 |
| JP | 3-102729 | | 4/1991 | H01H/37/76 |
| JP | 7-130277 | * | 5/1995 | |

* cited by examiner

*Primary Examiner*—Peter Vo
*Assistant Examiner*—Minh Trinh
(74) *Attorney, Agent, or Firm*—Sughrue Mion, PLLC

(57) ABSTRACT

A method for producing a fuse element having a fusible portion and any other portion which are made of different kinds of metal. The method comprises the steps of boring through-hole in a substrate made of first metal, forming an element plate by fusion-bonding a second metal to the through-hole and integrally stamping a pair of substrate portion made of the first metal and a low-melting-point portion made of the second metal. The second metal is made of a metal whose melting point is lower than that of the first metal. Further, the pair of substrate portion is connected together by the low-melting-point portion so that the fuse element is formed.

6 Claims, 3 Drawing Sheets

METHOD FOR PRODUCING A FUSE ELEMENT

This is a divisional of application Ser. No. 09/212,278 filed Dec. 16, 1998, now U.S. Pat No. 6,163,244 the disclosure of which is incorporated herein by reference.

BACKGROUND OF THE INVENTION

1. Field of the Invention

The present invention relates to a method for producing a fuse element made of different kinds of metal and used specifically in the principal part of a fuse and to a fuse element produced with the method.

2. Description of the Related Art

A method for producing a fuse element made of different kinds of metal is disclosed in, for example, Japanese Patent Unexamined Patent Publication No. Hei. 3-102729. As shown in FIG. 4(A), a tape-like through-lay type composite material 5 is used in the method in Hei. 3-102729. The tape-like through-lay type composite material 5 comprises a fuse alloy 1 arranged in the center of the material 5 and copper 3 arranged on both sides of the fuse alloy 1 as a lead piece. Window holes 7 are bored at predetermined intervals in the longitudinal direction of the tape-like through-lay type composite material 5 so that the fuse alloy 1 can have a predetermined volume, then a material 9 is obtained as shown in FIG. 4(B). Next, as shown in FIG. 4(C), a part of the fuse alloy 1 in the material 9 is sealed up with epoxy resin 11. Finally, as shown in FIG. 4(D), the material 9 is cut with a press accordingly at an even interval in the longitudinal direction, then a fuse 13 is obtained.

Nevertheless, the method of producing the aforementioned fuse element makes it essential to use the tape-like through-lay type composite material as a stock. In order to obtain the tape-like through-lay type composite material, copper as a lead piece is welded by electron-beam onto both the lateral sides of the fuse alloy disposed in the center of the fuse element. The electron-beam welding generally requires a vacuum chamber because a heat source is energy derived from the high-speed electron beams generated in a vacuum. Therefore, as well as production facilities for them, such fuse elements costs much. On the other hand, non-vacuum electron-beam welding-machines is developed and makes welding operation possible under the atmospheric pressure. However, the non-vacuum electron-beam welding machines requires attention to protect against X-rays.

In addition, electron-beam welding tends to cause porosity in products because the rate of solidification in the weld is high, which results in making bubbles hardly escapable from the fusion-welded portion. Another problem still arises from the formation of unevenness within the boundary between the different kinds of metal if a density of the beam energy is unstable. Therefore, these undesirable factors have made it difficult to obtain high-precision fuse elements.

SUMMARY OF THE INVENTION

In view of the aforementioned situation, an object of the present invention is to provide a method for producing an inexpensive precision fuse element made of different kinds of metal. In addition, a further object is to provide a fuse element produced with the same.

The above object of the present invention can be attained by a method for producing a fuse element having a fusible portion and any other portion which are made of different kinds of metal. The method comprises the steps of boring a through-hole in a substrate made of a first metal, forming an element plate by fusion-bonding a second metal to the through-hole and integrally stamping a pair of substrate portion made of the first metal and a low-melting-point portion made of the second metal. The second metal is made of a metal whose melting point is lower than that of the first metal. Further, the pair of substrate portion is connected together by the low-melting-point portion so that the fuse element is formed.

Through this method, a fuse element made of different kinds of metal can be formed without using a tape-like through-lay type composite material which necessitates using electron-beam welding. Moreover, since the low-melting-point metal is fusion-bonded to the through-hole thus bored by stamping, it is possible to form a boundary free from unevenness between the different kinds of metal which tends to develop at the time welding.

In the above method, it is preferable that the step of forming the element plate comprises the steps of providing a low-melting-point metal chip substantially the same shape as the through-hole, inserting the low-melting-point metal chip into the through-hole and fusion-bonding the low-melting-point metal chip to the through-hole by heat-melting the low-melting-point metal chip.

Through this method, the low-melting-point metal chip substantially similar in configuration to the through-hole is formed beforehand and heat melted so as to fusion-bonded to the through-hole, whereby the fusible portion is formed of low-melting-point metal having a constant volume at all times.

Furthermore, in the above step of forming the element plate, it is also preferable that the low-melting-point metal chip is provided by stamping a uniform-thickness plate made of the second metal.

In above step of forming the element plate, it is also preferable that injecting and fusion-bonding a melted second metal into the through-hole.

Furthermore, in the above method for producing a fuse element, it is more preferable that the low-melting-point metal portion is stamped out so as to have a small-width portion whose width is narrower than one of a large-width portion which is defined at a edge portion of the low-melting-point metal portion adjacent to the substrate portion.

In the above method for producing a fuse element, it is more preferable that the small-width portion is formed in the substatially center portion of the low-melting-point metal portion.

The above further object of providing a fuse element is can be attained by a fuse element produced by a method comprising the steps of boring through-hole in a substrate made of first metal, forming an element plate by fusion-bonding a second metal to the through-hole, the second metal made of a metal whose melting point is lower than that of the first metal, and integrally stamping a pair of substrate portion made of the first metal and a low-melting-point portion made of the second metal. The pair of substrate portion is connected together by the low-melting-point portion so that the fuse element is formed. The fuse element has a small sectional area portion whose sectional area is smaller than that of any one of both end portions of the low-melting-point metal portion.

With this fuse element, the small sectional area portion is formed in the fusible portion and certainly fused and broken, so that visual inspection can be improved at the time of fusing.

Furthermore, it is more preferable that the small sectional area portion is formed in a substantial center portion of said low-melting-point-metal portion.

It is also preferable that the substrate is in a form of a flat plate.

Furthermore, it is more preferable that the substrate is in a form of a plate having a recessed cross section in a thickness direction of said substrate.

It is also preferable that the recessed cross section is U-shaped in a cross section.

DETAILED DESCRIPTION OF THE PREFERRED EMBODIMENTS

A detailed description will subsequently be given of a method for producing a fuse element according to the present invention and a preferred embodiment of such a fuse element with reference to the drawings.

Figure 1A:
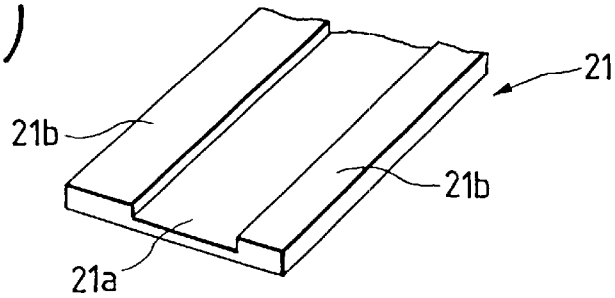
FIGS. 1(A)–1(D) are diagrams illustrating a production process according to the present invention.
Figure 1B:
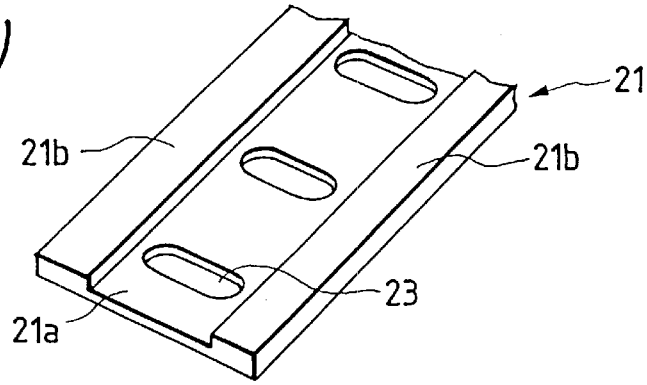
Figure 1C:
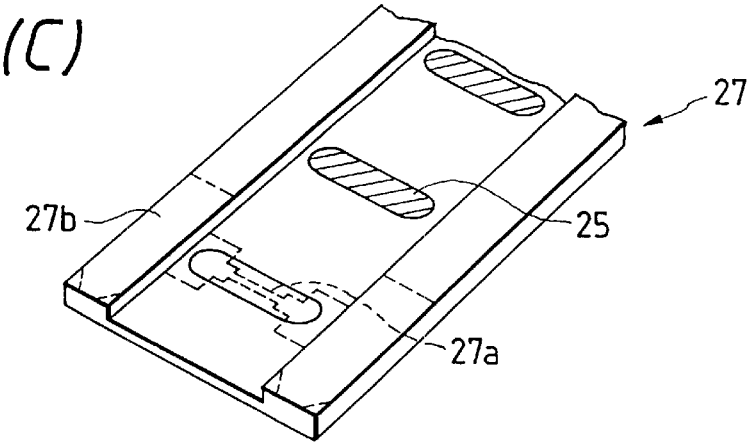
Figure 1D:
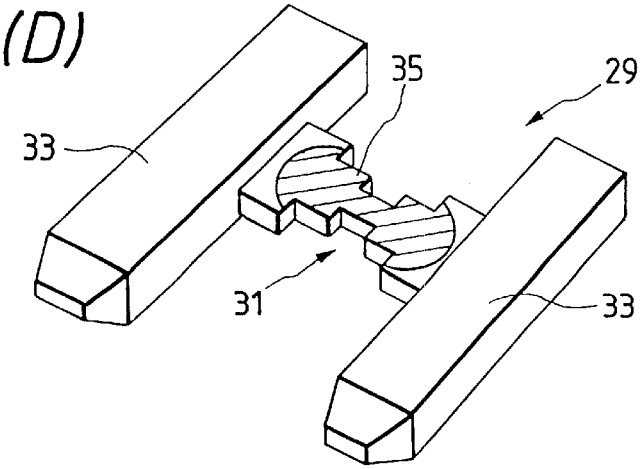
Figure 2:
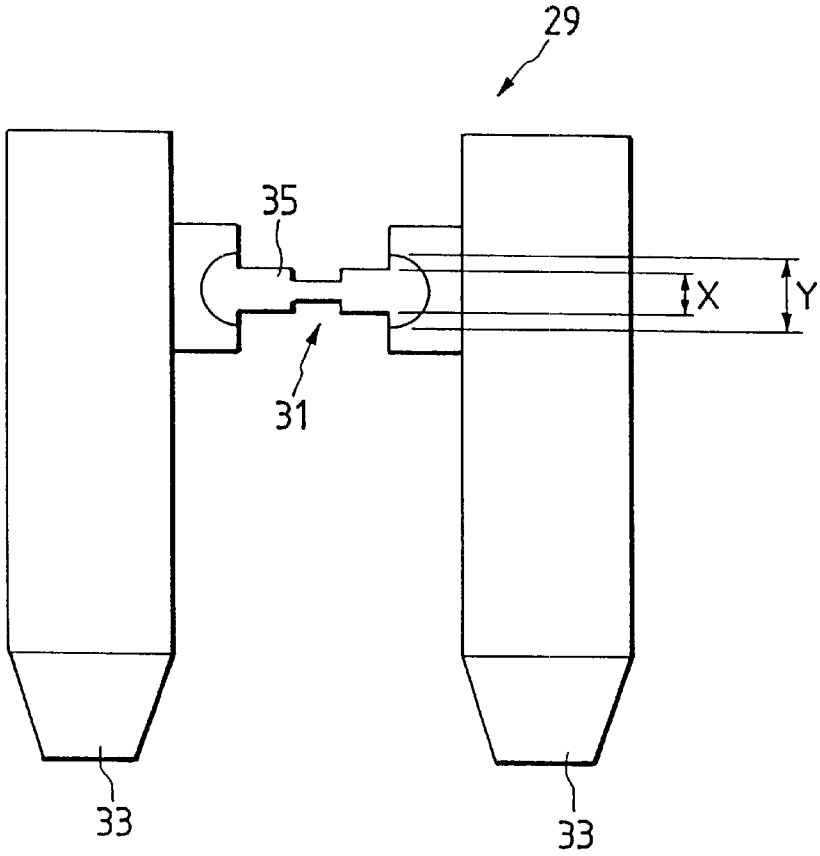
FIG. 2 is a top view of a fuse element obtained through the method according to the present invention.

FIG. 1 shows diagrams illustrating a production process according to the present invention; and FIG. 2, a plan view of a fuse element obtained through the production process according to the present invention.

In this production process, a belt-like material made of copper or copper alloy as shown in FIG. 1(A) is employed as a substrate 21. The substrate 21 is used for forming terminal portions of fuse elements after stamping, which will be described hereinafter. Although the substrate 21 may be in the form of a flat plate having a thickness, a plate having a recess in cross section as a thin-wall portion 21*a* in its center is described by way of example according to this embodiment of the invention. In this example, thick-wall portions 21*b* which hold a thin-wall portion 21*a*, extending in the longitudinal direction of the substrate 21, therebetween form a pair of terminal portions.

As shown in FIG. 1(B), through-holes 23 extending in the respective thick-wall portions 21*b* are bored in a predetermined interval in the longitudinal direction of the substrate 21, and a low-melting-point metal 25 is fusion-bonded to each of the through-holes 23 as shown in FIG. 1(C).

Next, so as to fuse the through-hole 23 and the low-melting-point metal 25, for example, a low-melting-point metal chip can be used. The low-melting-point metal chip is formed substantially similar in configuration to the through-hole 23 beforehand by stamping a plate (not shown). The low-melting-point metal chip is inserted and fused into the through-hole 23. As another example, the through-hole 23 and the low-melting-point metal 25 may be fusion-bonded by injecting the melted low-melting-point metal 25 into the through-hole 23.

In the aforementioned fusion bonding, only the low-melting-point metal 25 is fused and bonded to the substrate 21, but the substrate 21 remains infusible. Therefore, the melting (unevenness) of the boundary does not occur because the different kinds of metal do not melt as in the case of welding described above. The low-melting-point metal 25 can be made of, for example, copper alloy, gold, silver, tin or the like.

Then, an element plate 27 is obtained by fusion-bonding the low-melting-point metal 25 to the substrate 21. Next, as shown in FIG. 1(D), a fuse element 29 is obtained by integrally stamping a low-melting-point metal portion 27*a* and a pair of substrate portions 27*b* connected together by the low-melting-point metal portion 27*a* out of the element plate 27. Consequently, the fuse element 29 thus obtained has the low-melting-point metal portion 27*a* as a fusible portion 31 and the pair of substrate portions 27*b* as a pair of terminals 33.

Since the belt-like substrate 21 is used according to this example producing method, the plurality of fuse elements 29 can be obtained by sequentially stamping the belt-like substrate 21 from one end in the longitudinal direction thereof.

As shown in FIG. 2, when the fuse element 29 is stamped out of the element plate 27, the low-melting-point metal portion 27*a* is stamped out as the fusible portion 31 so as to have a small-width portion having a width of X. The width of X is smaller than a width of Y which is defined at the both sides of the low-melting-point metal portion 27*a*. The small-width portion is formed in the substatially; center portion of the fusible portion 31. In other words, the low-melting-point metal portion 27*a* has a small sectional area portion 35 whose sectional area is smaller than that of the other portion in the low-melting-point metal portion 27*a*.

According to the method of producing the aforementioned fuse element 29, it is possible to obtain the element plate 27 made of different kinds of metal by fusing-bonding the low-melting-point metal to the through-hole bored in the substrate 21. Therefore, the fuse element 29 made of different kinds of metal can be formed by stamping the element plate 27. This method does not necessitates; the tape-like through-lay type composite material, which use electron-beam welding, as in a method described in the background of the invention. As a result, the fuse element 29 is obtained in less costly production facilities because it is produced without electron-beam welding.

Since the low-melting-point metal is fusion-bonded to the through-hole bored by stamping, it is possible to form a boundary free from unevenness between the different kinds of metal in comparison with electron-beam welding for fusion-bonding both metals. This results in forming such a fuse element 29 with precision greater than that of the tape-like through-lay type composite material.

Furthermore, the fusion-bonding the low-melting-point metal 25 to the through-hole 23 is carried out by forming a low-melting-point metal chip substantially similar in configuration to the through-hole beforehand and heat-melting the low-melting-point metal chip, so that the low-melting-point metal 25 has a constant volume at all times. Consequently, fuse elements 29 uniform in fusing characteristics are obtainable when they are mass-produced.

Figure 3:
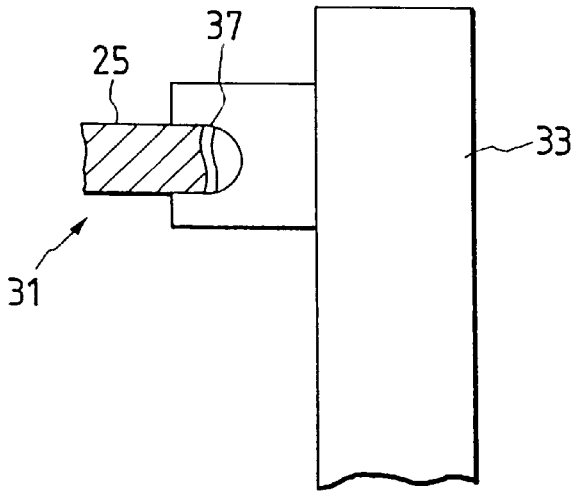
FIG. 3 is an enlarged view of a fusing condition when the fusible portion is formed with equal width.
Figure 4A:
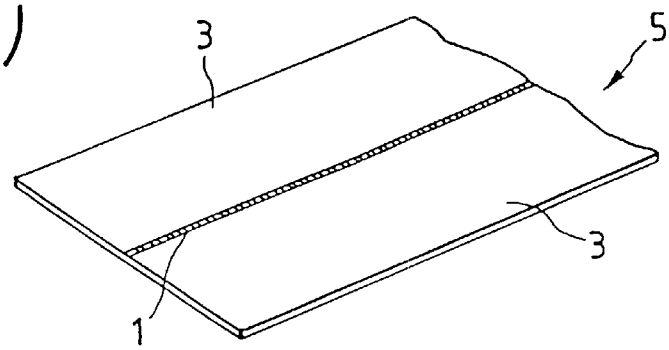
FIG. 4(A) PRIOR ART
FIGS. 4(A)–4(D) are diagrams illustrating a conventional production process.
Figure 4B:
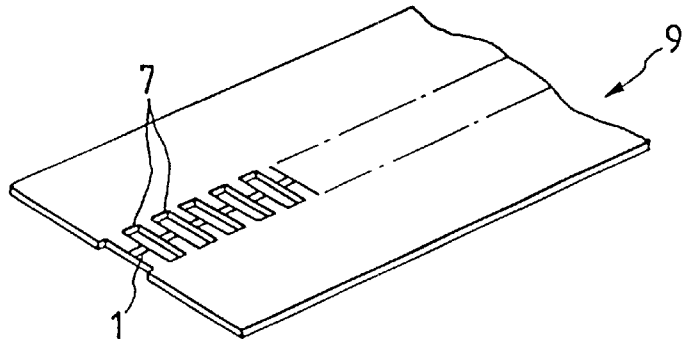
FIG. 4(B) PRIOR ART
Figure 4C:
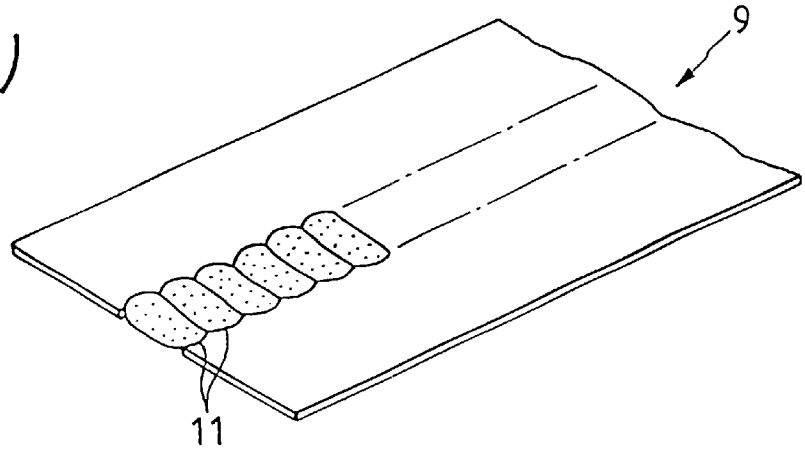
FIG. 4(C) PRIOR ART
Figure 4D:
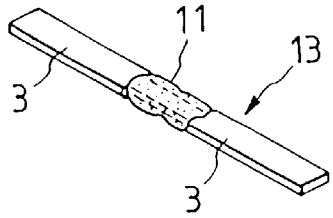
FIG. 4(D) PRIOR ART

As the fuse element 29 thus obtained through the aforementioned producing method is provided with the small sectional area portion 35 in the fusible portion 31, a fusible position can be specified in the small sectional area portion 35. In other words, the low-melting-point metal 25 may be fused and broken in the boundary portion 37 in the terminal 33 as shown in FIG. 3 when the fusible portion 31 is formed so that the width of the low-melting-point metal 25 may have a uniform width of Y. In such a state, the fusing portion becomes extremely difficult to making visual inspection, whereas the fuse element 29 according to the present invention improves visual inspection at the time of fusing because the small sectional area portion 35 is certainly broken by fusing.

As set forth above in detail, since the fuse element made of different kinds of metal can be produced through the method of producing the fuse element according to the present invention without using the tape-like through-lay type composite material which necessitates using electron-beam welding, it becomes possible to obtain not only fuse elements with inexpensive production is facilities but also reduce their production cost. By fusion-bonding the low-melting-point metal to the through-hole bored by stamping, it is possible to form a boundary free from unevenness between the different kinds of metal in comparison with the use of welding for fusion-bonding both metals, which results in forming such a fuse element 29 with precision greater than that of the tape-like through-lay type composite material.

Through the method of producing the fuse element according to the present invention, fuse elements uniform in fusing characteristics are made obtainable by forming the low-melting-point metal chip substantially similar in configuration to the through-hole beforehand and heat-melting the low-melting-point metal chip.

As the fuse element according to the present invention has the small sectional area portion in the fusible portion, the fusible position can be specified in the small sectional area portion with the effect of improving visual inspection at the time of fusing.

The present invention is based on Japanese Patent Application No. Hei. 9-346542, which is incorporated herein by reference.

While only certain embodiments of the invention have been specifically describe herein, it will be apparent that numerous modification may be made thereto without departing from the spirit and scope of the invention.

What is claimed is:

1. A method for producing a fuse element having a fusible portion and an other portion which are made of different kinds of metal comprising the steps of:

boring through-hole in a substrate made of first metal;

forming an element plate by fusion-bonding a second metal to said through-hole, said second metal made of a metal whose melting point is lower than that of said first metal; and integrally stamping a pair of substrate portion made of said first metal and a low-melting-point portion made of said second metal, wherein said pair of substrate portion is connected together by said low-melting-point portion so that said fuse element is formed.

2. The method according to claim 1, in which said forming step comprising-the steps of:

providing a low-melting-point metal chip substantially the same shape as said through-hole;

inserting said low-melting-point metal chip into said through-hole; and fusion-bonding said low-melting-point metal chip to said through-hole by heat-melting said low-melting-point metal chip.

3. The method according to claim 2, wherein said low-melting-point metal chip is provided by stamping a uniform-thickness plate made of said second metal.

4. The method according to claim 1, in which said forming step comprising the steps of:

injecting and fusion-bonding a melted second metal into said through-hole.

5. The method according to claim 1, wherein said low-melting-point metal portion is stamped out so as to have a small-width portion and a large width portion, said small width portion having a width being narrower than said large-width portion, said large width portion being defined at an edge portion of said low-melting-point metal portion adjacent to said substrate portion.

6. The method according to claim 5, wherein said small-width portion is formed in the substatially center portion of said low-melting-point metal portion.

* * * * *